United States Patent [19]

Matyja

[11] Patent Number: 4,946,290

[45] Date of Patent: Aug. 7, 1990

[54] EXPANDABLE BAG

[76] Inventor: Krzysztof Matyja, 211-5777 Willingdon Avenue, Burnaby, B.C., Canada, V5H 4B1

[21] Appl. No.: 243,927

[22] Filed: Sep. 13, 1988

[51] Int. Cl.[5] ..... B65D 30/20; B65D 33/6

[52] U.S. Cl. ..... 383/10; 383/9; 383/22; 383/120; 383/907; 229/DIG. 3; 206/423

[58] Field of Search ..... 383/10, 906, 22, 77, 383/9, 15, 120, 907; 229/DIG. 3; 206/423, 0.5

[56] References Cited

U.S. PATENT DOCUMENTS

| | | | |
|---|---|---|---|
| 1,692,777 | 11/1928 | Jewell | 229/DIG. 3 |
| 1,811,574 | 6/1931 | Barrett | 206/423 |
| 2,362,459 | 11/1944 | Barnett | 206/0.5 |
| 3,402,729 | 9/1968 | Kinzler | 383/10 |
| 3,834,528 | 9/1974 | Pickford et al. | 229/DIG. 3 |

FOREIGN PATENT DOCUMENTS

| | | | |
|---|---|---|---|
| 1137672 | 10/1962 | Fed. Rep. of Germany | 206/423 |
| 393176 | 10/1965 | Switzerland | 206/423 |
| 1129663 | 10/1968 | United Kingdom | 383/906 |
| 2056410 | 3/1981 | United Kingdom | 206/423 |
| 2171077 | 8/1986 | United Kingdom | 383/10 |
| 2174361 | 11/1986 | United Kingdom | 383/10 |

*Primary Examiner*—Stephen P. Garbe
*Assistant Examiner*—Jes F. Pascua

[57] ABSTRACT

A flexible bag having a tapered body portion with a closed bottom narrower than a top thereof. The bag has a handle portion and a folding portion coupling the body portion to the handle portion. The handle portion includes two handle halves separable to open the bag. The bag is movable from a flat position in which the holding portion is folded to an expanded unfolded position in response to the weight of objects to be carried.

17 Claims, 3 Drawing Sheets

EXPANDABLE BAG

The present invention relates to an expandable flexible bag for holding various fragile objects such as fresh cut flowers, floral arrangements and small plants.

BACKGROUND OF THE INVENTION

A variety of different methods and bag structures for packaging or displaying flowers and floral arrangements and the like have been used over the years. The most common method of packaging cut flowers, for example, still practised by flower shops, consists of wrapping the flowers in paper formed into a conical shape with the tops of the flowers exposed. No provision is available in such a packaging method for insuring the continued freshness of the flowers by, for example, placing them in a moisturized, completely enclosed structure. There is also no method available in such a system for allowing the packaged flowers to be hung from a convenient hook.

A more protective and costly wrapping structure consists of rigid plastic or carton boxes. However, the latter still present problems with retaining plant freshness. Some florists address the latter problem by utilizing blocks of special foam or water-resistant synthetic resin materials which receive the stems of the cut flowers or plants. There are also separate small plastic containers filled with water and closed with a rubber lid having openings for insertion of a single flower stem that are used. However, these methods are costly and inconvenient.

An early solution to the problem of preservation during transportation of cut flowers is disclosed in U.S. Pat. No. 2,774,187 issued to Smithers in December, 1956. The Smithers patent discloses a package which includes a water-retentive container with a block of water-absorbant synthetic resin material and a transparent flexible water- and air-proof sheeting enclosing the container and the flowers. The stems of the flowers are inserted in the block of resin material. The Smithers patent requires the separate steps of moistening the block, inserting the container within the bag and inserting the flowers into the block. In addition to the complex and cumbersome steps involved, Smithers does not provide adequate space for the flower heads during transportation.

An alternative method is disclosed in U.S. Pat. No. 3,323,640 issued June, 1967 to Kugler. Kugler discloses a flexible package consisting of at least two compartments interconnected by a perforate or porous wall. The porous wall allows the passage therethrough of a pre-determined quantity of a liquid or gaseous substance stored in one of the containers to keep the flowers fresh. Kugler requires a water-tight seal within the bag. In addition, Kugler does not provide adequate space for flower heads and is unsuitable for longer-stemmed flowers.

U.S. Pat. No. 3,657,840 issued to Benoist in April, 1972 discloses a continuous flexible supporting strip with moisture absorbing abilities contained within a sealed transparent bag. The flowers are affixed to the strip and then an outer bag is welded or bonded to close the structure. Benoist, therefore, involves a very time consuming procedure for placing the flowers within the bag.

An improved bag is disclosed in U.S. Pat. No. 3,874,115 issued on Apr. 4, 1975 to London in which an elongate bag having an inflatable member secured within to prevent spilling of liquid within the bag and to surround and engage the flower stems is used. London does not provide any structure for protecting the flower heads.

Finally, U.S. Pat. No. 4,491,217 issued on Jan. 1, 1985 to Weder et al. discloses an expandable corsage bag which, however, does not contain any means to retain moisture for inserted flowers. Accordingly, it is an object of the present invention to provide an improved bag for transporting cut flowers, plants and floral arrangements.

SUMMARY OF THE INVENTION

According to the invention there is provided a flexible bag which includes a tapered body portion with a closed bottom narrower than at top thereof, a handle portion, and a folding portion coupling the body portion to the handle portion. The handle portion includes two separable halves to allow access. The bag changes form from a flat position in which the folding portion is folded to an expanded unfolded position by the weight of bag contents such as flowers and water.

Advantageously, the folding portion with the bag in a flat position includes a first fold and a second fold with the first fold overlying the second fold. The first fold is coupled to the second fold by a first neck portion intermediate ends of the first fold and the second fold is coupled to the body portion and handle portion by a second neck portion intermediate ends of the second fold. The widths of the first and second neck portions are substantially less than widths of the first and second folds, respectively.

Preferably, the body portion has a substantially triangular shape in its flat position with an apex at the bottom thereof and equal side lengths joining ends of the folding portion to the apex. In the expanded position the body portion has an approximate quadrilateral pyramidal shape. Thus, the stems of cut flowers may be held within a narrow region at the bottom of the body portion and the expanded region may then accommodate the flower heads in a widened region. Advantageously, the bottom portion is water-impervious so that a small amount of water can be retained within the bag to keep the flowers fresh.

The handle portion has a pair of stiffening members and a pair of handle grips affixed to respective ones of said members extending across a part of said handle portion. The handle opening is located centrally of the handle porton when the bag is in flat form. The stiffening member keeps the bag from collapsing around the handle opening and deforming the upper portion of the bag.

The handle portion may also include an opening proximate one end thereof for suspending the bag vertically from a hook or the like without deforming the bag and a tear strip at an opposite end for tearing and forming a tie strip for tying to a projection and suspending the bag therefrom in a vertical position.

BRIEF DESCRIPTION OF THE DRAWINGS

The novel features believed characteristic of the invention are set forth in the appended claims. The invention itself, however, as well as other features and advantages thereof, will be best undestood by reference to the detailed description which follows, read in conjunction with the accompanying drawings, wherein:

DETAILED DESCRIPTION WITH REFERENCE TO THE DRAWINGS

Figure 1:
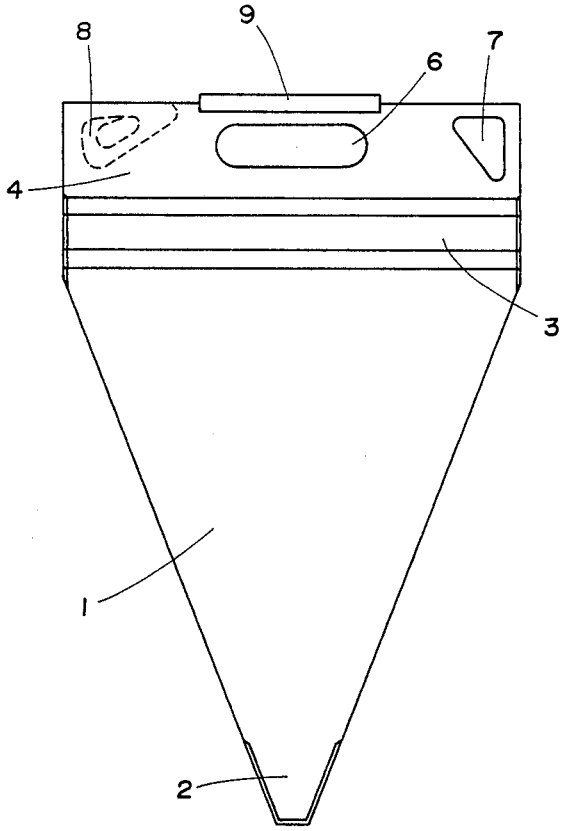
FIG. 1 is a front elevation view of a preferred embodiment of the invention in a folded position.

Referring to FIG. 1 there is shown a front elevation view of the bag when flat. The bag includes a triangular shaped body portion 1, one apex 2 of which is located at the bottom and sides of which extend upwards from the apex 2 an equal distance to either side of a folded region 3. A handle portion 4 is coupled to the body portion 1 by means of the folded portion 3. The handle portion 4 is made up of two halves of flat sheet material 5 through each of which there are aligned elongated slots 6 forming a handle opening. To one side of the handle portion 4 there is formed a triangular shaped opening 7 which is used to store the bag on a hook (not shown) without causing deformation of the bag. On the opposite end there is a tear strip 8 which can be torn to form a tie strip for tying the bag to a projection. With the bag suspended on a hook (not shown) through opening 7 or by tie strip 8 the bag is still held vertically due to the side of the bag below the opening 7 or strip 8 contacting an assocated vertical surface (not shown). A stiffening member 9 is attached to the handle portion along the top thereof above the opening 6 in order to prevent the bag from collapsing when in use. In the absence of a stiffening member 9 the shape of the bag when in use would not be retained.

Figure 2:
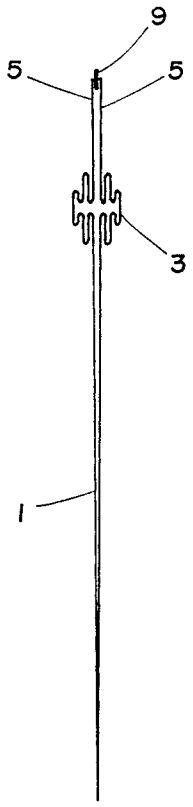
FIG. 2 is a side elevation view in cross-section of the embodiment of FIG. 1.
Figure 3:
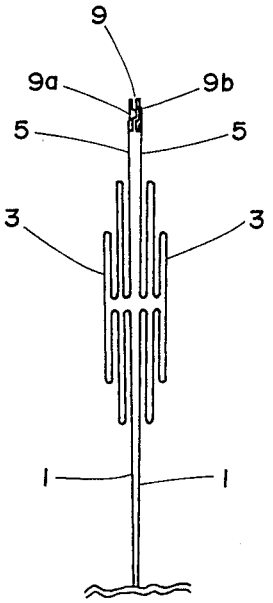
FIG. 3 is a side elevation also in cross-section view showing only an expanded portion of the top of FIG. 2.
Figure 4:
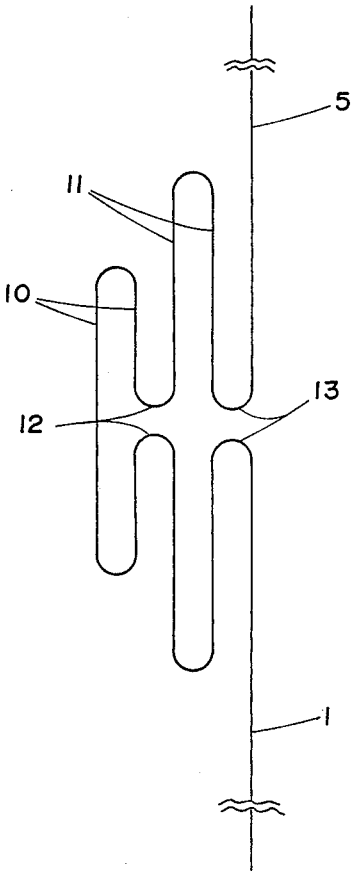
FIG. 4 is a partial view in cross-section showing one half of the folding portion seen in FIGS. 2 and 3.
Figure 6:
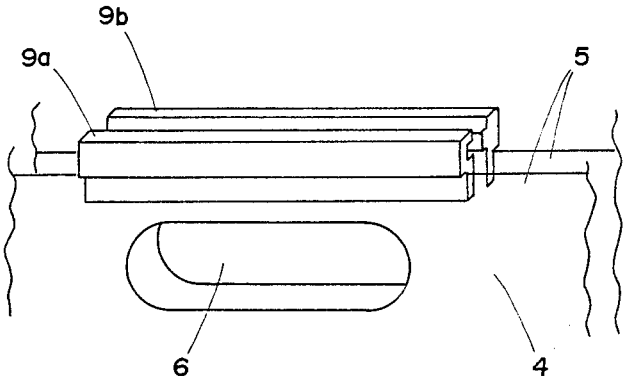
FIG. 6 is a partial view of a handle portion of the bag in accordance with the preferred embodiment of the invention.

As shown in FIGS. 2 and 4, the folded region 3 is made up of outer folds 10 and inner folds 11, integrally connected by neck regions 12 and 13, respectively, to each other and to t he walls 1 and 5 of the bag, respectively. As shown in FIG. 3, the stiffening member 9 consists of two elements 9*a* and 9*b* affixed to opposite sides of the handle portion 4 and having a rib on portion 9*a* and a corresponding rib socket on half 9*b* dimensioned to receive the rib from portion 9*a*. This structure can be more clearly seen in FIG. 6.

Figure 5:
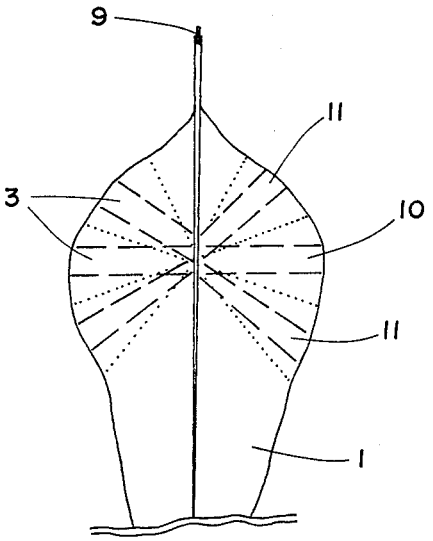
FIG. 5 is a side elevation view of a portion of the embodiment of FIG. 1 in expanded form.
Figure 8:
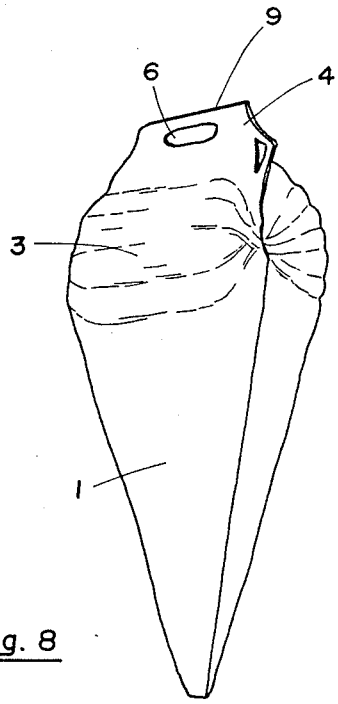
FIG. 8 is a perspective view of the bag in expanded form.

When expanded, the bag takes on a shape as shown in FIG. 5. In this case, the folds 10 and 11 are expanded and form a substantially continuous surface with the region around the folded portion being substantially expanded in an approximately partial cylindrical shape joining the body portion 1 as shown in FIG. 8 which is in the approximate form of a quadrilateral pyramidal structure.

The folded portion 3 when unfolded provides a large area to accommodate flower heads. In addition, the stem lengths of the flowers may vary and still have the flower heads positioned to be in a substantially widened region whether they are within the region of the folding portion 3 or slightly below it.

The bag material may be made of plastic film of a thickness at least 0.3 mm with two symmetrical halves of such film being bonded together along the edges to form seams o the body portion by a localized heating process or an ultrasonic process.

The bottom end of the container in region 2 would normally employ double bonding in order to prevent leakage resulting from any accidental pressure caused by sudden movement of the bag or an external object impacting thereon. The narrowed portion at the bottom of the bag not only serves to constrain the flower stems but it also reduces the amount of water necessary to keep the flowers moist. A reduction in the amount of water reduces correspondingly the total weight of the bag.

Figure 7:
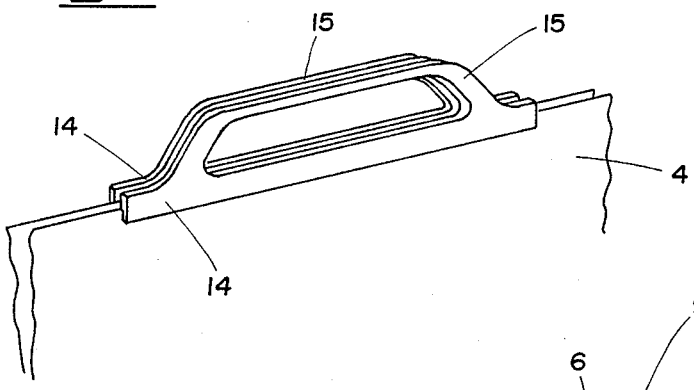
FIG. 7 is a partial perspective view of an alternative handle and stiffening member arrangement.

Alternatively, the handle portion 4 may consist of a pair of stiff plastic members each including a stiffening bar 14 and integral handle grip 15 above the bar 14 as seen in FIG. 7.

Accordingly, while this invention has been described with reference to illustrative embodiments, this description is not extended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A flexible bag, comprising:

a tapered body portion with a closed bottom narrower than a top thereof;

a handle portion; and a folding portion coupling said body portion to said handle portion such that on folding, said body portion pivots about the bottom of said body portion to become substantially flat and on unfolding said folding portion expands outwardly to form an enlarged chamber intermediate the top and bottom of said body while a remaining lower portion of body portion pivots open about the bottom wherein the fold creases provide rigidity and resist the tendency of the body pulling in against its contents in response to the weight of those contents;

wherein said handle portion includes two handle halves separable to open said bag to provide access to an interior thereof and movable from a flat position in which said folding portion is folded to an expanded unfolded position in response to the weight of bag contents.

2. A bag according to claim 1, wherein said folding portion with said bag in the flat position includes a first laterally extending fold and a second laterally extending fold, said first fold overlying part of said second fold and coupled thereto by a first neck portion intermediate ends of said first fold and said second fold coupled to said body portion and handle portion by a second neck portion intermediate ends of said second fold, the width of said first and second neck portions being substantially smaller than the width of said first and second folds, respectively.

3. A bag according to claim 2, wherein said body portion has a substantially triangular shape in its flat position with an apex at the bottom thereof and equal side lengths joining ends of the folding portion to said apex and in the expanded position has an approximate shape of a quadrilateral pyramid.

4. A bag according to claim 3, wherein said bottom is water impervious.

5. A bag according to claim 2, wherein said folding portion is integral with said body portion and said handle portion.

6. A bag according to claim 2, wherein said handle portion includes a perforated pattern on a corner thereof such that the tearing of said perforations produces a tie strip affixed to said handle portion for tying said bag to an external projection suspended vertically.

7. A bag according to claim 1, wherein said handle portion has a handle opening and a stiffening member extending across a portion of said handle portion above or below said handle opening with said handle opening located centrally of a notional vertical plane bisecting said bag when in a flat position.

8. A bag according to claim 7, wherein said handle portion includes an opening proximate one end thereof for suspending said bag vertically from an external hook without causing said bag to deform.

9. A bag according to claim 7, wherein said stiffening member is an elongated bar attachable to a part of said handle portion.

10. A bag according to claim 9, wherein said handle portion includes handle openings in said separable halves and said stiffening member is attached to said handle halves and extending across a substantial part of the openings.

11. A bag according to claim 1, wherein said handle portion includes a pair of elongated bars attached to a portion of said separable halves and a pair of handle grips affixed to respective ones of said bars such that with said bag supported from said handle grips said bag hangs vertically.

12. A bag according to claim 11, wherein said handle portion includes an opening proximate one end thereof for suspending said bag vertically from an extended hook without causing said bag to deform.

13. A bag according to claim 11, wherein said handle portion includes a perforated pattern on a corner thereof such that the tearing of said perforations products a tie strip affixed to said handle portion for tying said bag to an external projection such that said bag is suspended vertically.

14. A flexible bag for carrying flowers and the like, comprising:

a tapered water impervious body narrow at the bottom;

a handle portion having separable halves with each half having a handle opening and an elongated stiffening member extending across a substantial part of the opening;

a folding portion joining said body to said handle portion, flat in a folded position and expansible with pivoting of said body portion about said bottom to have a substantially smooth continuous surface with said folding portion forming an intermediate enlarged region with fold intersections that provide rigidity and resist being pulled in against the contents in response to the weight of the contents.

15. A bag according to claim 14, wherein said body, handle portion and folding portion are made from two symmetrical integral sheets of material bonded along their edges to form seams.

16. A bag according to claim 15, wherein said folding portion includes inner and outer flat folds extending laterally around said bag from one seam to the other and with the outer fold overlying a part of the inner one, both the outer and inner folds and the inner fold and said body and handle portion interconnected by respective narrow necked regions positioned centrally of said inner and outer folds.

17. A bag according to claim 14, wherein said body has a triangular shape with a truncated apex at the bottom and sides of equal length extending up to sides of said folding portion.

* * * * *